US005375492A

United States Patent [19]

Smitterberg et al.

[11] Patent Number: 5,375,492

[45] Date of Patent: Dec. 27, 1994

[54] APPARATUS AND METHOD FOR SLITTING CORRUGATED PAPERBOARD BOXES

[75] Inventors: Dean W. Smitterberg; Richard F. Paulson; William R. Nachtrab, Jr.; Timothy C. Prochnow, all of Phillips; Eugene C. Carlson, Westboro, all of Wis.

[73] Assignee: Marquip, Inc., Phillips, Wis.

[21] Appl. No.: 65,935

[22] Filed: May 24, 1993

Related U.S. Application Data

[63] Continuation-in-part of Ser. No. 878,681, May 5, 1992, abandoned.

[51] Int. Cl.[5] ..... B26D 1/04; B31B 1/14

[52] U.S. Cl. ..... 83/13; 83/419; 83/420; 83/468.6; 83/646; 83/794

[58] Field of Search ..... 83/29, 56, 418, 419, 83/420, 467.1, 468.1, 468.6, 392, 636, 644, 646, 647, 697, 794, 799, 801, 13, 820; 493/343, 372

[56] References Cited

U.S. PATENT DOCUMENTS

| | | | |
|---|---|---|---|
| 1,653,662 | 12/1927 | Ritchie | 83/794 X |
| 3,118,337 | 1/1964 | Ferris | 83/799 X |
| 3,174,375 | 3/1965 | Westra | 83/384 |
| 3,580,123 | 5/1971 | Westra et al. | 83/380 |
| 3,786,708 | 1/1974 | Mumper | 83/681 X |
| 3,861,262 | 1/1975 | Carpenter et al. | 83/642 |
| 4,397,598 | 8/1983 | Ess et al. | 83/468.6 X |
| 4,597,748 | 7/1986 | Wolf | 493/29 |
| 4,850,257 | 7/1989 | Mohr | 83/420 X |
| 5,158,522 | 10/1992 | Cummings et al. | 83/418 X |
| 5,209,149 | 5/1993 | Mohr | 83/467.1 X |

*Primary Examiner*—Eugenia Jones

*Attorney, Agent, or Firm*—Andrus, Sceales, Starke & Sawall

[57] ABSTRACT

A stack of folded and glued corrugated paperboard boxes is slit in unison with a thin cutting blade having a linear cutting edge disposed parallel to the plane of the boxes and moved through the stack in an angular direction to slit essentially one box at a time. The stack is squared before slitting to align the box edges, however, the force of the blade on the stack as it moves therethrough holds the receding stack together such that the cut halves of each box may part laterally as the blade passes therethrough to avoid any crushing of the corrugated paperboard media.

24 Claims, 4 Drawing Sheets

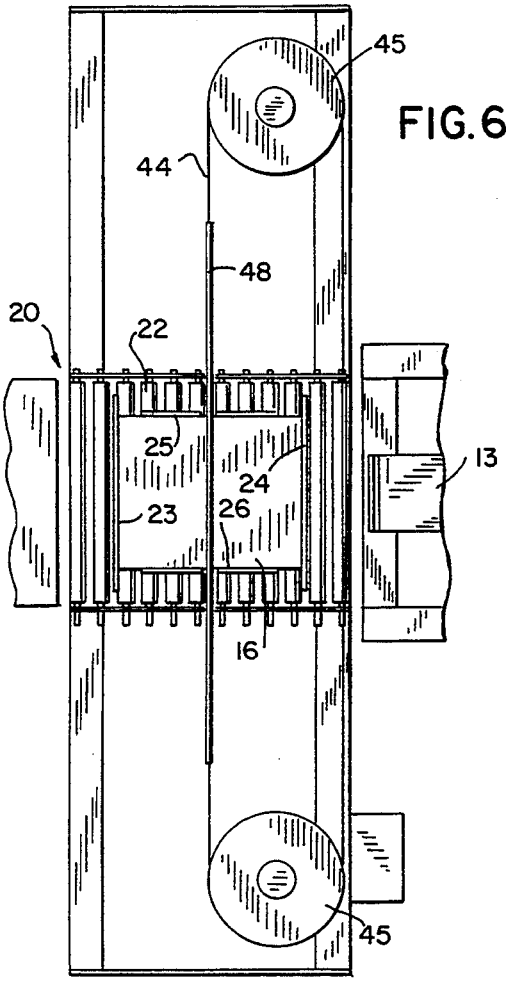
FIG.6
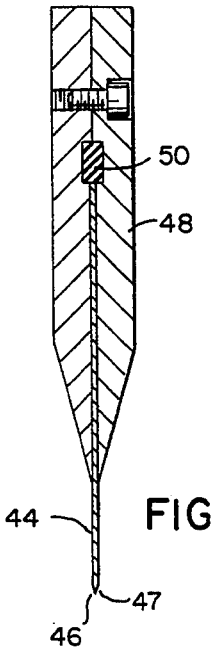
FIG.8
FIG.7
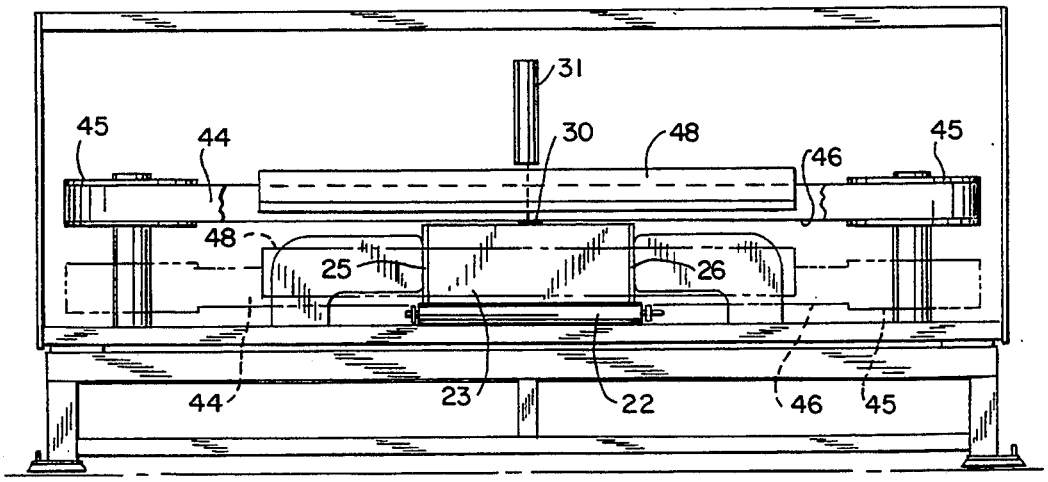

APPARATUS AND METHOD FOR SLITTING CORRUGATED PAPERBOARD BOXES

This is a continuation-in-part application of Ser. No. 07/878,681, filed May 5, 1992 abandoned.

BACKGROUND OF THE INVENTION

The present invention relates to slitting boxes made of corrugated paperboard and, more particularly, to an apparatus and method for slitting knocked down boxes in a stack formed in a stacking device as the boxes exit from a folding and gluing apparatus.

Corrugated paperboard box blanks are conventionally printed, folded and glued to form what are referred to as "knocked down boxes" in a flexo-folder-gluer apparatus. This apparatus includes a flexographic printer, a folding mechanism which folds opposite sides of the blank along pre-scored lines, and a gluing device which applies an adhesive along the overlapping edges of the laterally folded sides. The flattened container or knocked down box is thus completely formed and, after the glue dries, the boxes can be stacked and banded for shipment and subsequent assembly. It is known in the art to stack the knocked down boxes exiting the flexo-folder-gluer (hereinafter sometimes referred to as a "flexo") to utilize the stack weight to hold the glued edges together until the glue sets. It is also known in the art to form a shingle of knocked down boxes as they exit from the flexo, also utilizing the weight of the overlapping boxes in the shingle to hold the box position until the adhesive dries.

The knocked down boxes typically assembled in a flexo are of a conventional construction, including four sides, the overlapping edges of two sides of which are glued together on a glue tab, and four slotted end flaps extending integrally from opposite ends of the sides to eventually form the top and bottom closure flaps when the box is subsequently assembled. As indicated, these knocked down boxes are ordinarily finished containers and require no further processing, apart from stacking and banding for shipment. However, it is also known in the art to assemble certain special constructions of knocked down boxes in a flexo, which boxes are subsequently slit into two or more parts to form smaller containers of either a conventional or modified type. For example, it is known to assemble a large regular slotted container (RSC) and subsequently slit the same along a median line to form two half slotted containers, each of which comprises a knocked down container with side walls and bottom flaps or top flaps, but not both. Similarly, a large special regular slotted container can be formed in a flexo-folder-gluer in the form of two integrally attached half size regular slotted containers by forming the blank with special double length center slots which, when bisected as the large special RSC is subsequently slit in half perpendicular to the center slots, form the two half-size RSCs.

Although the formation of the foregoing types of large knocked down boxes, which must be subsequently slit for end use, is well known, production of such boxes on a large scale has never been achieved, primarily because of difficulties in slitting them. Corrugated paperboard sheet stock is conventionally slit longitudinally by the use of a pair of upper and lower cooperating slitting blades which operate as a shear-type cutter. It has been found, however, that such dual knife shear cutters do not provide clean cuts with heavy and/or multi-wall corrugated board. Shear-type slitting inherently causes a vertical displacement of the adjacent slit edges of the board and, as the board thickness increases or as multiple layers are slit, the relative vertical displacement becomes larger and a ragged cut edge typically results. The multiple board layers presented by a knocked down box result in the same characteristic ragged cuts when shear-type slitters are used.

In addition, slitting large special containers exiting a flexo-folder-gluer has typically been done as an off-line process. In other words, the large knocked down boxes are taken off the flexo, moved to another location, and slit individually to form two half-size knocked down boxes. Even with this technique, the longitudinal slits are typically less than satisfactory because of the use of shear-type slitting devices. In addition, registration of the boxes, meaning lateral alignment so that the slit is directly on the centerline of the large regular or special slotted container, is difficult to attain with conventional off-line methods in which one box at a time is slit.

Nevertheless, real advantages in production volume and box quality could be attained with an apparatus and method which would slit large regular or special slotted containers to form two half-size containers in an on-line basis. Furthermore, small containers are typically not run on a flexo-folder-gluer because small container blanks are extremely difficult to handle, not only in the flexo, but in upstream material handling devices as well. Thus, there is a real need in the industry for a system which can provide for the manufacture of high quality small size knocked down boxes, but will also utilize a flexo-folder-gluer in its most effective and efficient manner.

In one known prior art method, the on-line slitting of knocked down boxes is accomplished by forming a shingle of the boxes as they exit the flexo, unshingling the boxes downstream and feeding them one at a time through a conventional shear-type slitter, and then separately reshingling or stacking each of the series of half-size boxes. However, this process is slow, causes loss of box registration, and still results in ragged slit edges on the boxes.

It is also known to form knocked down boxes from a flexo-folder-gluer into a shingle and to slit the shingle on-line using a single thin high speed rotary slitting blade. Various techniques for slitting corrugated boxes in this manner are shown in U.S. Pat. No. 5,158,222, and the apparatus for slitting such boxes is more broadly described in U.S. Pat. No.5,090,281. Although high speed slitting with a single rotary slitting blade has improved substantially the quality of cuts, as well as processing speeds, excessive box handling equipment and steps are still required.

SUMMARY OF THE INVENTION

In accordance with the present invention, knocked down boxes from a flexo-folder-gluer are stacked in a conventional counter ejector and the entire stack is transferred into a linear blade slitter which cuts through the entire stack, leaving two smaller regular slotted containers of either special or conventional construction. It has been found that a thin cutting blade, properly supported and driven at a small enough angle through the stack, can readily cut through a stack of folded knocked down boxes if properly oriented to slit essentially one box at a time and to allow the cut halves to part sequentially as the blade passes through the stack.

The apparatus of the present invention includes means for supporting one face of a stack of knocked down boxes, means for squaring the boxes to align the cut edges, a cutting blade which is positioned adjacent the opposite end of the stack and having a cutting edge that is disposed parallel to the cut edges of the boxes, and means for moving the cutting blade through the stack in an angular direction toward the supported end of the stack and across the folded edges of the boxes so that essentially one box at a time in the stack is slit. The cutting blade has a length greater than the distance across the stack as measured between the opposite folded edges of the boxes. The blade has a slitting depth, measured along the blade from and perpendicular to the cutting edge, which is at least as great as the thickness of a single folded box.

It has also been found that, notwithstanding the thin construction of the slitting blade, the downward force of the blade on the layers of corrugated paperboard comprising the boxes will crush the corrugated medium unless the blade is moved through the stack at a small acute angle with respect to the plane of the end face of the stack (the plane of the means used to support the stack).

In one embodiment, the stack supporting means comprises a conveyor which supports the stack and carries it into a slitting position adjacent the cutting blade. The slitting position is established by the squaring means which preferably comprises first and second squaring pans which are positionable above the conveyor and adapted to engage the cut edges of the boxes in response to operation of the conveyor. One or both of the squaring pans are moved out of engagement with the stack in response to movement of the cutting blade into cutting engagement to allow the boxes to part as they are successively slit.

Various types of linear slitting blades may be used, including a thin flexible blade clamped in a rigid blade support to expose only a small edge portion which defines the required slitting depth. This blade preferably has a cutting edge defined by symmetric beveled edge faces on opposite sides. Another blade may utilize a planar edge face on one side, positioned to move in the cutting plane through the stack, and a tapered or angled edge face on the opposite side. In both cases, the blades are preferably demountable from their respective holders. The blades may be moved through the stack for cutting on a linear track means mounted for reciprocal movement through the cutting and return strokes. The linear track is preferably positioned at an angle to provide a ratio of horizontal to vertical movement of at least 5:1. The term "horizontal" is used to define movement in a plane parallel to the boxes or to the support for the boxes. The term "vertical" is a direction normal to that plane.

In another embodiment, the cutting blade may comprise a continuous flexible band which operates linearly in one direction through a rigid blade guide with the guide and moving blade operated to pass directly through the stack of boxes. In this embodiment, linear blade movement is preferably at a speed at least ten times as great as the speed of movement of the blade through the stack in a direction normal to the linear blade movement.

The basic method of slitting a stack of folded corrugated paperboard boxes, in accordance with the present invention, includes the steps of supporting the stack of boxes on one end face, squaring the stack to align the cut edges of the boxes, positioning a linear cutting blade adjacent the opposite face of the stack with the blade oriented parallel to the cut edges of the boxes, and passing the cutting blade through the stack in the direction of the cutting edge and at an acute angle to the stack support to slit essentially one box at a time. During cutting, the box edge squaring means on at least one side of the stack, depending on the type of blade used, must be moved laterally away to allow each box to part in a direction normal to the slit line as the cutting blade passes through the box.

BRIEF DESCRIPTION OF THE DRAWINGS

FIG. 6 is a top plan view of a slitting apparatus showing another embodiment of the cutting blade.

FIG.7 is an end elevation similar to FIG. 3 showing the FIG. 6 embodiment of the cutting blade.

FIG. 8 is an enlarged sectional view of the embodiment of the cutting blade shown in FIGS. 6 and 7.

DETAILED DESCRIPTION OF THE PREFERRED EMBODIMENTS

Figure 1:
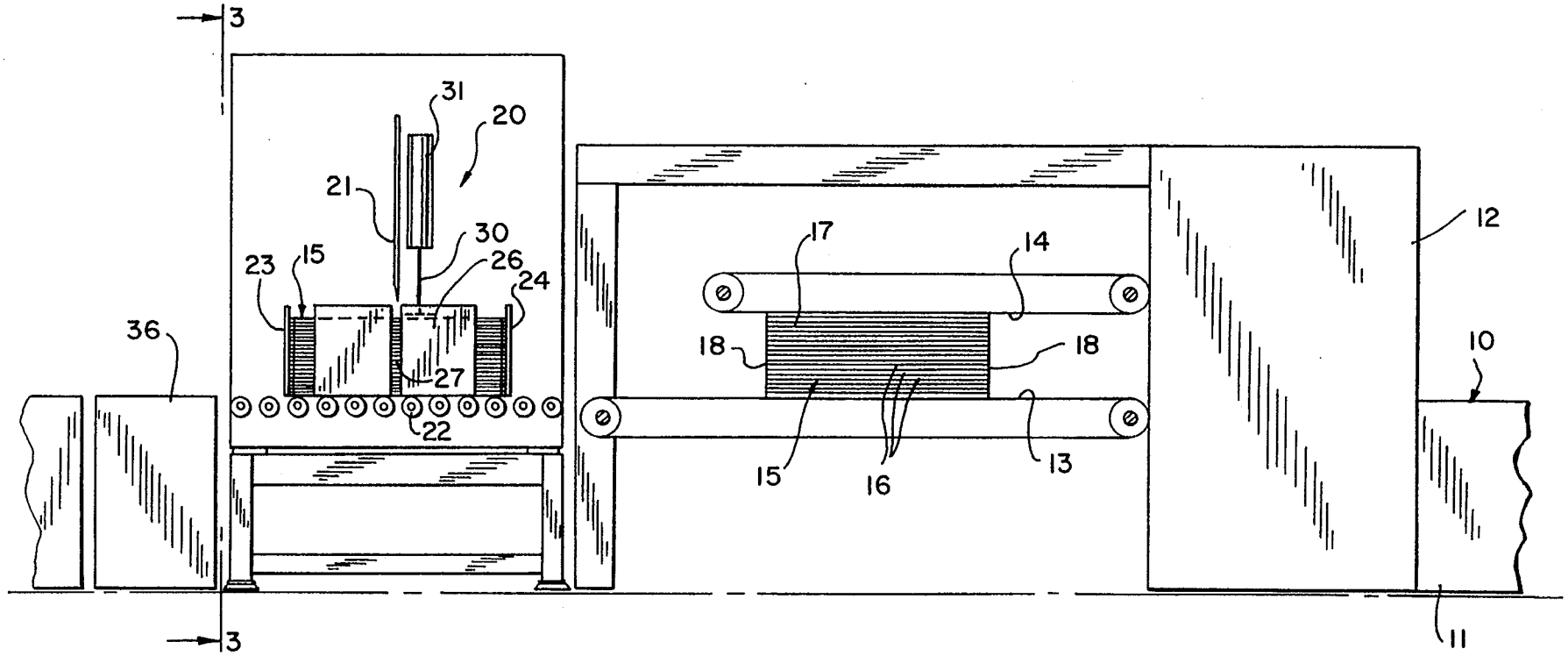
FIG. 1 is a schematic side elevation view of the box slitter of the present invention.
Figure 2:
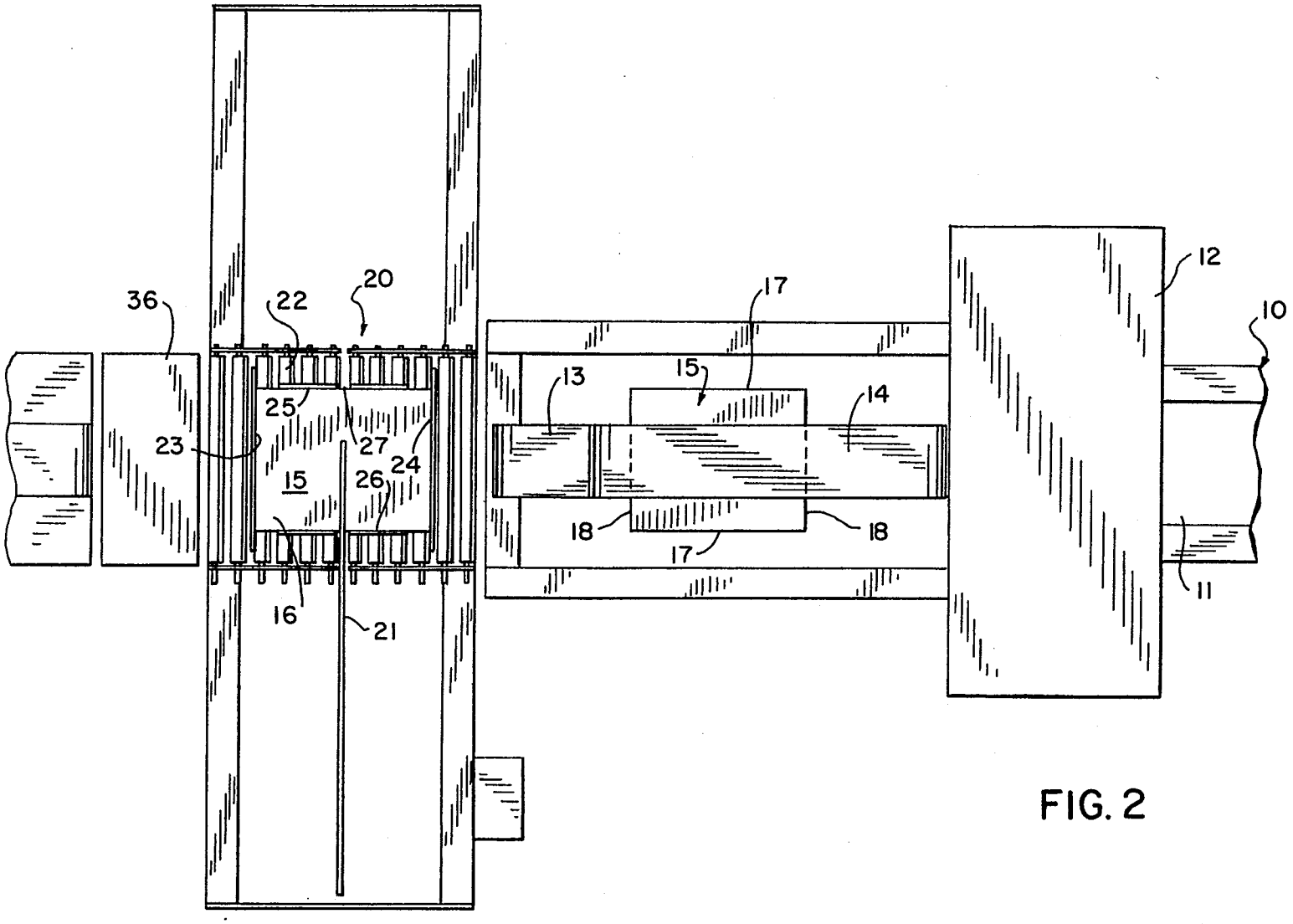
FIG. 2 is a top plan view of the box slitter shown in FIG. 1.
Figure 3:
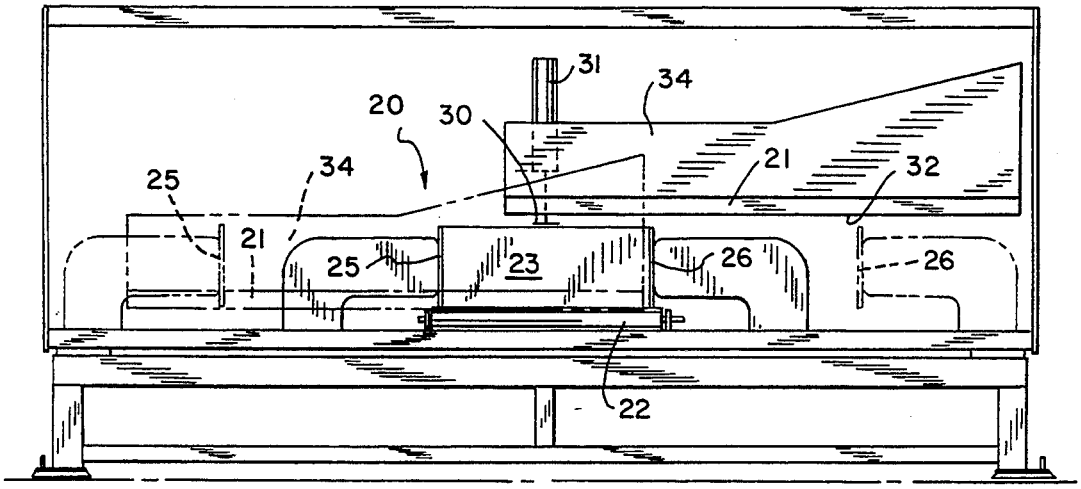
FIG. 3 is a sectional elevation view taken on line 3—3 of FIG. 1.

Referring initially to FIGS. 1–3, knocked down boxes of corrugated paperboard are formed from flat blanks in a flexo-folder-gluer 10, where the blanks are initially printed and the side edges folded laterally toward one another and glued together along a thin glue tab on the overlapping edges. The folded knocked down boxes exiting the folding section 11 of the flexo 10 are formed in a vertical stack of a pre-selected number of boxes in a conventional counter ejector 12. The corrugated containers made from double wall board (i.e. 3 liners enclosing two corrugated media) have a folded two layer thickness of 0.56 inch (14.2 mm), such that a stack of 20 boxes formed in the counter ejector 12 would be about 11.2 inches (28.5 cm) high. Because of the inherent spring back in the folded boxes, the free-standing stack is somewhat higher and the stack is fed from the counter ejector between a lower discharge conveyor 13 and an upper compression conveyor 14 to compress the stack 15 to its nominal 14 inch height.

It will be appreciated that, as is well known in the industry, the folded edges 17 of the boxes 16 comprise the lateral edges as each box is formed in the flexo and lie parallel to the line of box movement through the flexo 10. Correspondingly, the cut edges 18 of the boxes are oriented transversely to the direction of box movement. The boxes are moved through the counter ejector 12 and between the conveyors 13 and 14 without any reorientation in the horizontal plane, so that the stack 15 of boxes arrives at the inlet of the box slitter 20 with the lead face of the stack defined by cut edges 18. The box slitter 20, in the presently preferred embodiment, includes an elongate linear cutting blade 21 which is adapted to move simultaneously across and downwardly through the stack 15 in a direction parallel to the cut box edges 18 to divide each knocked down box 16 into two smaller boxes.

The box slitter 20 includes a slitter conveyor 22 which receives the stack 15 of boxes from the discharge conveyor 13 and carries the stack into slitting position. Slitter conveyor 22 may comprise a conventional live roll conveyor which will conveniently accommodate receipt of the cutting blade 21 as it passes a short distance through the bottom of the stack 15. In order to assure uniform and accurate slits, the cut edges 18 of the boxes in the stack must be squared and vertically aligned before slitting. A first squaring pan 23 is positionable above the slitter conveyor 22 and adjustable in the direction of stack movement into the slitter to establish an initial stop for the stack to center it below the cutting blade 21. After the stack has engaged the first squaring pan, a second squaring pan 24 is put into position over the slitter conveyor 22 and moved into engagement with the cut edges on the other side of the stack 15 to cause the stack to be accurately squared between the two pans 23 and 24. The pans may be positioned and moved into stack engagement in any convenient manner, but preferably the pans are movable in a vertical direction to allow them to be pulled up and out of the way of the stack after it is slit in two and ready for discharge from the slitter. However, tilt up pans may also be utilized.

The slitter also includes a pair of stop pans 25 and 26 which are separately positionable and moveable into engagement with the folded edges 17 of the boxes on opposite sides of the stack 15. Because of normal folded box spring back, the stack may be slightly unstable and, additionally, the horizontal component of blade movement in the slitting operation, to be described in more detail, may tend to cause relative horizontal movement between boxes in the stack if not restrained by one or the other of the stop pans 25 or 26. In the embodiment shown, the length of the stop pans in the direction of stack movement through the system is slightly less than the minimum desired dimension of stacks to be slit. On the other hand, the lengths of the squaring pans 23 and 24 in the direction normal to the stop pans (and normal to the direction of stack movement through the system) may be of any convenient size.

The stop pans 25 and 26 each include a vertical slot 27 to accommodate movement of the cutting blade 21 through the stack. The slots may also be used to provide additional blade support. The stop pans are preferably laterally adjustable to maximum inoperative positions far outside the box slitter 20, as may be seen in FIGS. 2 and 3, in order to accommodate pass through of unfolded paperboard blanks should it be desired.

Figure 4:
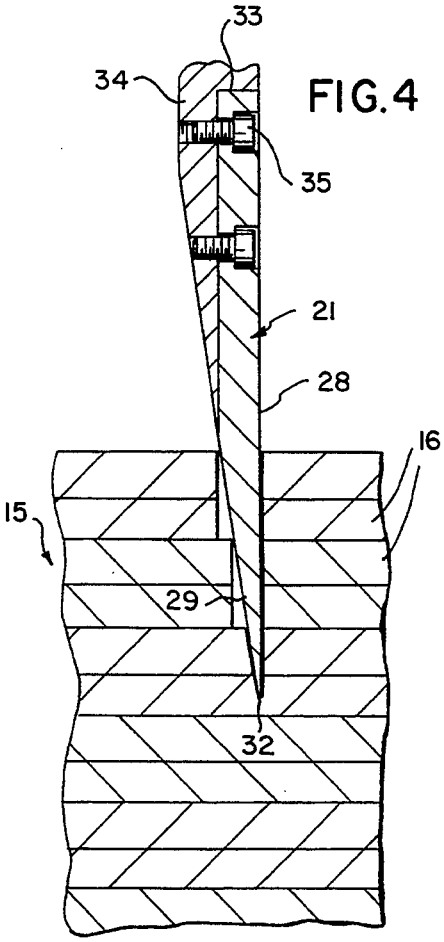
FIG. 4 is an enlarged sectional view through the cutting blade shown in FIGS. 1–3.

Referring also to FIG. 4, it has been found necessary to address several important considerations in order to provide accurate and essentially dust-free slits through a stack of boxes in a single pass of the cutting blade. First of all, the blade must be thin enough and the angle of the faces defining the blade cutting edge small enough to avoid imposing vertical crushing loads on the corrugated media (sometimes referred to as flutes) forming the interior portions of the box walls. Further, the boxes cannot be completely confined against movement normal to the cut as the cutting knife moves through the box and at least one of the two resulting half size boxes must be allowed to part laterally from the cut line. The blade should be long enough to pass angularly through the stack in one stroke, with the length ultimately determined by stack length and the angle at which the blade is moved. Further, it is also important that the blade be mounted to pass through the stack on a line which forms a small enough acute angle with respect to the plane of the boxes, also to avoid crushing the corrugated media.

The cutting blade 21 of the preferred embodiment shown in FIG. 4 has an asymmetrical cross section defined by one substantially planar edge face 28 and an opposite angled edge face 29. When using an asymmetrical cutting blade, it has been found desirable to utilize a holddown device 30 which engages the top surface of the stack 15 and holds it during the slitting operation. The holddown device 30 may comprise any convenient construction and may be operable by a vertically actuated holddown cylinder 31 or the like. The effective slitting depth of the cutting blade 21 comprises only a small portion of the total blade depth as measured from and perpendicular to the cutting edge 32 to its upper edge 33. The upper portion of the cutting blade 21 is mounted to a rigid blade holder 34 which is appropriately recessed to receive the upper end of the cutting blade via attachment with suitable machine screws 35 or similar fasteners.

The effective slitting depth of the blade 21 need only be deep enough to allow passage of the blade through the double thickness of one single folded box. If at least one side of the stack is unrestrained against lateral movement, each box will be allowed to part after it is slit and moved laterally away for passage of the thicker portion of the tapered blade thereof as well as the even thicker blade holder 34. Also, because the FIG. 4 blade has one vertical face 28, the box halves on that side of the slit do not have a tendency to part and may therefore be separately held during slitting. Utilizing the example of a box made of conventional double wall B/C flute paperboard, each double wall sheet is 0.28 inches (7.1 mm) thick and when formed into a folded box provides a box thickness of 0.56 inches (14.2 mm). Thus, the effective slitting depth of the blade need only be 0.56 inch (14.2 mm) and if the blade angle between the edge faces 28 and 29 is maintained small enough, each box in the stack may be sequentially slit without crushing. Each box is allowed to sequentially part laterally away from the blade and holder after slitting, as shown schematically in FIG. 4. When slitting a conventional folded box made of double wall corrugated board, an included angle between the blade edge faces of approximately 9.75°has been found effective. With this angle, the thickness of the blade at the upper edge of the effective slitting depth (0.56 inches or 14.2 mm above the cutting edge 32) is about ⅛ inch or 3.2 mm. It is believed that blades with smaller included angles could be effectively used, subject to other potential disadvantages such as decreased resistance to deflection or bending. A greater included angle between the edge faces has been found to result in some crushing of the corrugated media. When utilizing the asymmetrical blade shown in FIG. 4, the side of the stack adjacent the vertical planar edge face 28 of the blade is held by the holddown device 30 and only the slit box halves on the opposite side of the blade adjacent the angled edge face 29 need be allowed to part.

As may be best seen in FIG. 3, the blade holder 34 is substantially larger and much heavier than the cutting blade 21. The blade holder 34 is mounted in a suitable carriage to move linearly at an angle from its inoperative solid line position above the stack 15 downwardly through and laterally across the stack to the dotted line end of stroke position with the lower cutting edge 32 having passed fully through the stack (and through the vertical slots 27 in the stop pans 25 and 26) and a short distance between the adjacent center rolls of the slitter conveyor 22. The blade length and angle of linear movement must be coordinated so that, for the maximum desired width of folded boxes to be slit, the leading tip of the blade edge is fully across the top of the stack such that the uppermost box is fully engaged by the cutting edge 32 on initial contact. Further, the trailing end of the cutting blade must have passed below the plane of the bottom of the stack before the lowermost face of the bottom box has been slit. The angle of linear movement must comprise a fairly small acute angle with respect to the plane of the surface of the supporting slitter conveyor 22 and in the cutting plane. If the angle of linear movement does not have a horizontal component of movement which is at least five times greater than the vertical component of movement, crushing of the corrugated media of the boxes may occur. The minimum 5:1 ratio of these components results in an acute angle of roughly 11° . The carriage upon which the blade and blade holder travel may comprise any suitable arrangement, such as rails carrying the blade holder on suitable rollers attached to the holder. Likewise, blade movement may be provided by any suitable motive power means, such as fluid cylinders, chain drive, or the like.

In a normal sequence of operation of the box slitter 20, a stack 15 of boxes is delivered to the slitter conveyor 22 and is carried thereby into engagement with the first squaring pan 23 which has previously been positioned half the length of the stack from the vertical plane of the cutting blade 21. The second squaring pan 24 is then brought into contact with the cut edges of the boxes on the opposite side of the stack so that the cut edges on both sides are accurately squared and the stack is exactly centered below the cutting blade. The stop pans 25 and 26 are brought into engagement with the folded edges of the boxes on opposite sides of the stack and the holddown device 30 is brought down into contact with the stack on one side of the blade. The magnitude of the holddown force is not believed to be particularly important, but is believed to be helpful in preventing relative movement of overlapping box portions at the glue tab before the glue may have set and to provide a more uniform horizontal surface for initial engagement by the cutting blade. However, it has been found that the vertical load imposed on the stack by the blade itself, which may be in the range of 1,500 to 2,500 pounds, provides adequate holding force which is maintained as the blade passes through the stack on each succeeding box until the blade has passed therethrough and the resulting box halves have parted. Prior to actual slitting and once the holddown device 30 has been operated to engage the upper surface of the stack, the first squaring pan 23 is moved out of contact with the side face of the stack and is moved laterally away at least far enough to accommodate lateral movement of the box halves allowing full passage of the blade holder through the stack. After the stack has been slit and the blade retracted, the pans are moved out of the way and the slitter conveyor 22 carries the two stack halves onto a short outfeed conveyor 36 and then onto downstream conveying and handling equipment for banding and palletizing. The downstream conveying equipment may include devices for separating the stack halves and/or turning the slit stacks to orient them for banding, all in a manner well known in the industry. Obviously, the slit stack halves may be banded together or separately.

Figure 5:
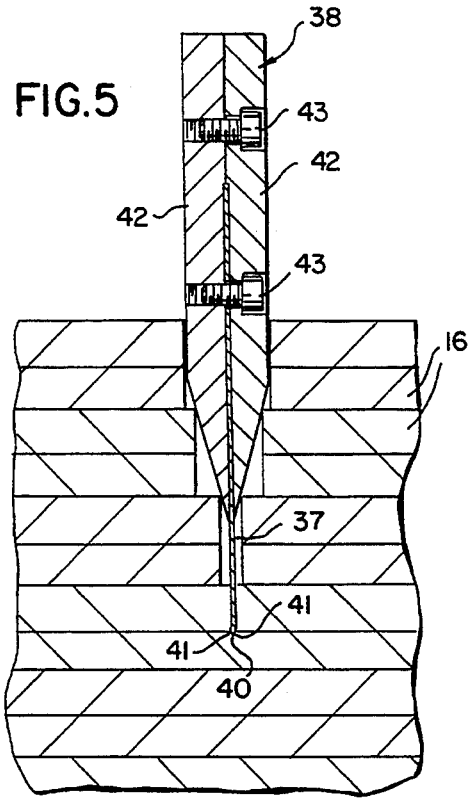
FIG. 5 is an enlarged sectional view of an alternate embodiment of the cutting blade.

Referring to FIG. 5, another embodiment of the cutting blade utilizes a thin blade 37 which has a uniform thickness over its total blade depth such that it extends into a rigid blade holder 38 a distance substantially greater than the effective slitting depth which is determined in a manner similar to that described with respect to the blade shown in FIG. 4. The blade 37 has a symmetrical cutting edge 40 defined by identical oppositely angled edge faces 41. The blade 37 is suitably clamped between the blade holder halves 42 with machine screws 43 or the like. As in the previously described embodiment, the blade holder preferably has a length substantially equal to the length of the cutting blade 37, the length of which in turn depends on the maximum stack length and the angle at which the blade operates. The effective slitting depth of the blade 37 from its cutting edge 40 up to the lower ends of the blade holder halves 42 need only be sufficient to allow the blade to pass fully through a two layer folded box before the box is engaged by the blade holder and must be allowed to part. In this manner, the boxes may be slit one at a time and the slit box halves allowed to part laterally in opposite directions without being crushed. It is believed that a slitting blade as thick as ⅛ inch (3.2 mm) may be utilized, however, substantially thinner blade may also be utilized and generally result in cleaner cuts and less potential crushing of the corrugated media.

Because the slit box halves part in opposite lateral directions when utilizing the FIG. 5 cutting blade, both the first and second squaring pans 23 and 24, respectively, must be moved laterally away from engagement with the sides of the stack prior to passage of the cutting edge of the blade through the uppermost box in the stack. The pans must be moved far enough to accommodate the full thickness of the blade holder 38 in a manner similar to the previously described embodiment.

Referring to FIGS. 6–8, another embodiment of the cutting blade utilizes a continuous flexible blade band 44 which is operated in one direction around a pair of spaced pulleys 45 in the manner of a conventional band saw. However, the cutting blade is otherwise somewhat similar to the blade 37 of the FIG. 5 embodiment and preferably has a symmetrical cutting edge 46 defined by identical oppositely angled edge faces 47. It is believed, however, that an asymmetrical blade edge could also be utilized and, in such case, a holddown device 30 identical to that used in the embodiment shown in FIGS. 1–4 would also be utilized.

The continuous blade band 44 operates through a rigid blade guide 48 which is at least as long as the maximum length of the stack of boxes to be cut and is deep enough to hold all of the blade except for the relatively short section adjacent the cutting edge defining the desired slitting depth (i.e. the thickness of a folded box). The blade guide, blade band and pulleys are adapted to move in unison downwardly through the stack 15 of boxes 16 as the blade is moving linearly through the guide 48 and between the pulleys to slit the stack in two. The blade guide 48 may be conveniently made of two pieces, as in the previously described embodiments. The blade band 44, however, must not be clamped, rather must be free to slide in the guide. Preferably a hardened backing member 50 equal in length to the length of the blade guide is positioned therein to provide a bearing surface for the upper edge of the blade. Any suitable source of motive power may be utilized to provide the reciprocal movement of the blade, blade holder and pulleys between the solid line inoperative position above the stack shown in FIG. 7 and the lowermost dashed line position showing the blade after it has passed fully through the stack. The remainder of the box slitter of this embodiment, including the slitter conveyor 22, squaring pans 23 and 24, and stop pans 25 and 26 may be identical to those described in the prior embodiments.

The blade band 44 is preferably operated at a relatively high speed, such as 1,200 fpm (6 m/sec.), as compared to a substantially slower speed of downward movement of the blade and guide through the stack, for example, 120 fpm (0.6 m/sec.). This 10:1 ratio of horizontal to vertical movement results in an effective angle of linear movement of the blade through the stack of approximately 6° . However, as with the previously described blade embodiment, an angle as high as about 11° would be suitable, although the tendency to crush the corrugated board media is reduced as the angle is decreased.

In all of the embodiments of the present invention, the ability to process a stack of boxes intact through the slitter, from the counter ejector to banding and palletizing, avoids the complexities of separating or shingling the boxes for slitting, helps retain the integrity of uncured glue joints, and eliminates the need for restacking prior to strapping. In all embodiments, the vertical load imposed on the stack by the downwardly moving cutting blade has been found to be capable of firmly holding the continuously descending uncut stack while allowing each succeeding slit box half to part, thereby precluding blade binding in the stack.

Any of the three embodiments of slitting blades described herein may be provided with means for automatic blade edge resharpening, lubrication to reduce friction and prevent glue buildup on the blade, and/or means to remove or wipe glue from the blade. Such sharpening, lubrication and glue removal mechanisms may be readily adapted from prior art rotary slitting blade technology described in the patents identified above.

Various modes of carrying out the present invention are contemplated as being within the scope of the following claims particularly pointing out and distinctly claiming the subject matter which is regarded as the invention.

We claim:

1. A method for slitting a stack of folded corrugated paperboard boxes, each box having a pair of opposite folded edges and a pair of opposite cut edges extending normal to the folded edges, said method comprising the steps of:

(1) supporting the stack with supporting means defining a planar surface and engaging one end face of the stack;

(2) squaring the stack to align the cut edges of the boxes;

(3) positioning a straight-edged cutting blade adjacent the other end face of the stack with the blade cutting edge parallel to the cut edges of the boxes; and, (4) passing the cutting blade through the stack in a cutting plane such that a point on the blade moves on a line at an acute angle of less than about 11° with respect to the plane of the supporting means to slit essentially one box at a time.

2. The method as set forth in claim 1 including the step of allowing the box to part in a direction normal to the slit as the cutting blade passes therethrough.

3. A method for slitting a stack of folded corrugated paperboard boxes, each box having a pair of opposite folded edges and a pair of opposite cut edges extending normal to the folded edges, said method comprising the steps of:

(1) providing a slitting station including a support for the stack engaging an end face of the stack;

(2) moving the stack in a path normal to the cut edges into the slitting station and onto the support;

(3) moving a first vertical squaring surface into the path of movement of the stack in the slitting station to engage the cut edges on the downstream side of the stack and to align the cut edges of the boxes;

(4) positioning a straight-edged cutting blade in the slitting station adjacent an end face of the stack with the blade cutting edge parallel to the cut edges of the boxes; and, (5) passing the cutting blade through the stack in a cutting plane such that a point on the blade moves on a line at an acute angle of less than about 11° with respect to the stack face support to slit essentially one box at a time.

4. The method as set forth in claim 3 including the step of allowing the box to part in a direction normal to the slit as the cutting blade passes therethrough.

5. The method as set forth in claim 3 including, prior to the step of passing the cutting blade through the stack, the step of moving a second vertical squaring surface into the path of movement of the stack in the slitting station to engage the cut edges on the upstream side of the stack to center the stack in the slitting station between said first and second squaring surfaces.

6. The method as set forth in claim 5 including the step of removing the first and second vertical squaring surfaces from direct engagement with the cut edges as the boxes are slit.

7. An apparatus for slitting a stack of folded boxes formed from corrugated paperboard having a corrugated paper media enclosed by a pair of face sheets, said boxes each having a pair of opposite folded edges and a pair of opposite cut edges extending normal to the folded edges, said apparatus comprising:

means defining a planar surface for supporting the stack in engagement with a face of a box on one end of the stack;

means for squaring the cut edges of the boxes;

a cutting blade positioned adjacent the other end of the stack and having a cutting edge disposed parallel to the cut edges of the boxes; and, means for moving the cutting blade through the stack in a cutting plane such that a point on the blade moves on a line disposed at an acute angle with respect to the plane of the stack supporting means, said blade moving toward said one end of the stack and across the folded edges of the boxes to slit essentially one box at a time without crushing the corrugated media, the acute angle being less than about 11° .

8. The apparatus as set forth in claim 7 wherein the cutting blade has a length greater than the distance between the opposite folded edges of the boxes.

9. The apparatus as set forth in claim 8 wherein the slitting depth of the cutting blade measured from and perpendicular to the cutting edge is at least as great as the thickness of a folded box.

10. The apparatus as set forth in claim 9 wherein the cutting blade comprises:

a thin blade having a total blade depth substantially greater than the slitting depth; and, rigid blade support means having a length corresponding to the blade length for clamping the blade therebetween to expose substantially only the edge portion defining the slitting depth.

11. The apparatus as set forth in claim 10 wherein the blade cutting edge is defined by identical opposite beveled edge faces.

12. The apparatus as set forth in claim 9 wherein the blade cutting edge is defined by one substantially planar edge face disposed to move in the cutting plane through the stack and an opposite angled edge face.

13. The apparatus as set forth in claim 12 including a rigid blade holder having a length corresponding to the blade length and means for demountably attaching the blade to the blade holder.

14. The apparatus as set forth in claim 9 wherein the means for moving the cutting blade comprises linear track means mounting the blade for reciprocal movement.

15. The apparatus as set forth in claim 9 wherein the cutting blade comprises:

a continuous flexible band having a total blade depth substantially greater than the slitting depth; and, rigid blade guide means having a length at least as great as the distance between the opposite folded edges of the boxes for guiding the blade during cutting movement and to expose substantially only the blade edge portion defining the slitting depth.

16. The apparatus as set forth in claim 7 wherein the stack supporting means comprises conveying means for supporting the stack from below and for moving the stack into a slitting position adjacent the cutting blade.

17. The apparatus as set forth in claim 16 wherein said squaring means comprises:

a first squaring pan positionable above the conveying means and engageable by the cut edges of the boxes on one side of the stack in response to movement of the stack into the slitting position; and, a second squaring pan positionable above the conveying means and moveable into engagement with the cut edges on the opposite side of the stack.

18. The apparatus as set forth in claim 17 including means for moving one of said squaring pans out of engagement with the stack in response to movement of the cutting blade into initial engagement with the stack.

19. The apparatus as set forth in claim 16 including stop means for engaging the folded edges of the boxes on one side of the stack in the slitting position and for holding the boxes against horizontal movement during cutting blade movement.

20. An apparatus for slitting a stack of folded boxes formed from corrugated paperboard having a corrugated media enclosed by a pair of face sheets, said boxes each having a pair of opposite folded edges and a pair of opposite cut edges extending normal to the folded edges, said apparatus comprising:

a slitting station including means for supporting the stack in engagement with a face of a box on one end of the stack;

means for conveying the stack into the slitting station;

squaring means movable into the path of stack conveyance in the slitting station for squaring the cut edges of the boxes and for centering the stack on a stack centerline between and parallel to said cut edges;

a cutting blade positioned adjacent an end of the stack in the slitting station and having a cutting edge disposed in the plane of the stack centerline and parallel to the cut edges of the boxes; and, means for moving the cutting blade through the stack in the cutting plane between the ends of the stack and across the folded edges of the boxes such that a point on the blade moves on a line disposed at an acute angle of less than about 11° with respect to the plane of the stack end face to slit essentially one box at a time without crushing the corrugated media.

21. The apparatus as set forth in claim 20 wherein said squaring and centering means comprises:

a first squaring pan positionable above the conveying means and engagable by the cut edges of the boxes on one side of the stack in response to movement of the stack into the slitting station; and, a second squaring pan positionable above the conveying means and moveable into engagement with the cut edges of the boxes on the opposite side of the stack.

22. The apparatus as set forth in claim 21 including means for moving said squaring pans out of engagement with the stack in response to movement of the cutting blade through the stack.

23. The apparatus as set forth in claim 20 including stop means for engaging the folded edges of the boxes on one side of the stack in the slitting station and for holding the boxes against horizontal movement during cutting blade movement.

24. The apparatus as set forth in claim 20 wherein the cutting blade has a slitting depth measured from and perpendicular to the cutting edge approximately equal to the maximum thickness of the folded box, and said blade further comprises:

a continuous flexible band having a total blade depth substantially greater than the slitting depth; and, rigid blade guide means having a length at least as great as the distance between the opposite folded edges of the boxes for guiding the blade during cutting movement and to expose substantially only the blade edge portion defining the slitting depth.

* * * * *